US006766544B1

(12) United States Patent
Lloyd et al.

(10) Patent No.: US 6,766,544 B1
(45) Date of Patent: Jul. 27, 2004

(54) DISPENSER FOR BATHTUB FAUCET

(76) Inventors: Brenda Lloyd, 2807 Heather Height Ct., Antioch, CA (US) 94531; Dan L. Edmond, 2807 Heather Height Ct., Antioch, CA (US) 94531

( * ) Notice: Subject to any disclaimer, the term of this patent is extended or adjusted under 35 U.S.C. 154(b) by 0 days.

(21) Appl. No.: 10/641,767

(22) Filed: Aug. 15, 2003

(51) Int. Cl.[7] ..... A47K 3/00
(52) U.S. Cl. ..... 4/559; 4/605
(58) Field of Search ..... 4/559, 605, 628, 4/661; 239/314

(56) References Cited

U.S. PATENT DOCUMENTS 2,625,430 A * 1/1953 Dorothy ..... 239/314
3,157,320 A * 11/1964 Sherriffe ..... 239/314
4,530,479 A * 7/1985 Chen ..... 248/309.1
5,274,858 A * 1/1994 Berry ..... 4/605
6,230,339 B1 * 5/2001 McCrink ..... 4/559
6,301,724 B1 * 10/2001 Wright ..... 4/559

FOREIGN PATENT DOCUMENTS

FR 2549361 A3 * 1/1985 ..... A47K/5/02

* cited by examiner

*Primary Examiner*—Tuan N. Nguyen

(57) ABSTRACT

A dispenser for dissolving solid soap pieces beneath a bathtub faucet has a basket that has a substantially trapezoidal shape. The basket has a top end, a bottom wall, a front wall, a back wall, a left wall and a right wall. The basket top end is open. The basket bottom wall has multiple of bottom wall perforations. The basket is capable of retaining solid soap pieces. A bracket is connected to the basket back wall and is connectable to a bathtub faucet.

10 Claims, 4 Drawing Sheets

DISPENSER FOR BATHTUB FAUCET

BACKGROUND OF THE INVENTION

1. Field of the Invention

The present embodiment of the invention relates to a dispenser for bathtub faucet for use in connection with fixtures for bathtub faucets. The dispenser for bathtub faucet has particular utility in connection with dispenser connectable to bathtub faucet.

2. Description of the Prior Art

Dispenser for bathtub faucets are desirable for dispensing soap at the faucet. A need was felt for a dispenser that would work with used small soap pieces that could be placed in a perforated basket for soaping a bath.

The use of fixtures for bathtub faucets is known in the prior art. For example, U.S. Pat. No. 5,274,858 to Berry discloses a shower soap assembly is provided for mounting to a shower head fixture. The assembly has open opposite ends and soap holding screens mounted within for holding a cake of soap. When soap is desired, the housing is moved to a down soap loaded position such that water from the shower head nozzle passes through the housing dissolving the soap, and soapy water is dispensed through the output end. When soap is no longer desired, the housing is moved to an upright position out of the path of the stream of water. However, the Berry '858 patent does not have the capability of utilizing small solid soap pieces and dispensing them at a bathtub faucet.

Similarly, U.S. Pat. No. 4,081,139 to Migliozzi discloses a multi-carrier dispenser attachment for shower heads is provided and comprises generally circular support means which are mounted externally of the shower head and which support a spaced plurality of different water soluble substances which may be selectively positioned within the stream of water emanating from the shower head for dissolving therein. In at least one position of the support means, no water soluble substance is disposed in the shower water stream, and a number of adjustment means are provided to enable the ready adjustment in the disposition of the respective substances in the shower water stream to optimize dispensing efficiency. However, the Migliozzi '139 patent does not have the capability of utilizing small solid soap pieces and dispensing them at a bathtub faucet.

Lastly, U.S. Pat. No. 4,131,232 to Pollinzi discloses an automatic shower dispenser for mixing controlled amounts of liquid additive to the shower water. The dispenser is attachable to the water inlet pipe of an ordinary shower head and includes a plastic refillable container for holding the liquid additive and dispensing it under the flow of gravity. A valve is positioned over the mouth of the receptacle for controlling the flow of liquid additive. A dispensing tube assembly communicates with the valve for allowing liquid additive to flow by gravity to a portion of the dispensing tube extending subjacent the nozzles of the shower head. A first series of discharge openings along the bottom portion of the dispensing tube assembly drips a continuous flow of liquid additive into the stream of shower water after it exits from the nozzle. In another embodiment, some of the spray of water exiting from the shower head is directed into a second series of openings along the portion of the dispensing tube adjacent the front of the shower head for mixing water and liquid additive and discharging it from the series of discharge openings on the bottom side of the dispensing tube. However, the Pollinzi '139 patent does not have the capability of utilizing small solid soap pieces and dispensing them at a bathtub faucet.

While the above-described devices fulfill their respective, particular objectives and requirements, the aforementioned patents do not describe a dispenser for bathtub faucet that allows dispenser connectable to bathtub faucet. The Berry '858, Migliozzi '139 and Pollinzi '139 patents make no provision for utilizing small solid soap pieces and dispensing them at a bathtub faucet.

Therefore, a need exists for a new and improved dispenser for bathtub faucet which can be used for dispenser connectable to bathtub faucet In this regard, the present embodiment of the invention substantially fulfills this need. In this respect, the dispenser for bathtub faucet according to the present embodiment of the invention substantially departs from the conventional concepts and designs of the prior art, and in doing so provides an apparatus primarily developed for the purpose of dispenser connectable to bathtub faucet.

SUMMARY OF THE INVENTION

In view of the foregoing disadvantages inherent in the known types of fixtures for bathtub faucets now present in the prior art, the present embodiment of the invention provides an improved dispenser for bathtub faucet, and overcomes the above-mentioned disadvantages and drawbacks of the prior art. As such, the general purpose of the present embodiment of the invention, which will be described subsequently in greater detail, is to provide a new and improved dispenser for bathtub faucet and method which has all the advantages of the prior art mentioned heretofore and many novel features that result in a dispenser for bathtub faucet which is not anticipated, rendered obvious, suggested, or even implied by the prior art, either alone or in any combination thereof.

To attain this, the present embodiment of the invention essentially comprises a basket that has a substantially trapezoidal shape. The basket has a top end, a bottom wall, a front wall, a back wall, a left wall and a right wall. The basket top end is open. The basket bottom wall has multiple of bottom wall perforations. The basket is capable of retaining solid soap pieces. A bracket is connected to the basket back wall and is connectable to a bathtub faucet.

There has thus been outlined, rather broadly, the more important features of the embodiment of the invention in order that the detailed description thereof that follows may be better understood and in order that the present contribution to the art may be better appreciated.

The present embodiment of the invention may also include a basket front wall perforation, a basket back wall faucet bore, a basket left wall perforation, a basket right wall perforation, and a securing screw. There are, of course, additional features of the present embodiment of the invention that will be described hereinafter and which will form the subject matter of the claims attached.

Numerous objects, features and advantages of the present embodiment of the invention will be readily apparent to those of ordinary skill in the art upon a reading of the following detailed description of presently preferred, but nonetheless illustrative, embodiments of the present embodiment of the invention when taken in conjunction with the accompanying drawings. In this respect, before explaining the current embodiment of the embodiment of the invention in detail, it is to be understood that the embodiment of the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present embodiment of the invention.

It is therefore an object of the present embodiment of the invention to provide a new and improved dispenser for bathtub faucet that has all of the advantages of the prior art fixtures for bathtub faucets and none of the disadvantages.

It is another object of the present embodiment of the invention to provide a new and improved dispenser for bathtub faucet that may be easily and efficiently manufactured and marketed.

An even further object of the present embodiment of the invention is to provide a new and improved dispenser for bathtub faucet that has a low cost of manufacture with regard to both materials and labor, and which accordingly is then susceptible of low prices of sale to the consuming public, thereby making such dispenser for bathtub faucet economically available to the buying public.

Still another object of the present embodiment of the invention is to provide a new dispenser for bathtub faucet that provides in the apparatuses and methods of the prior art some of the advantages thereof, while simultaneously overcoming some of the disadvantages normally associated therewith.

Even still another object of the present embodiment of the invention is to provide a dispenser for bathtub faucet for dispenser connectable to bathtub faucet.

Lastly, it is an object of the present embodiment of the invention is to provide a dispenser for bathtub faucet for dispensing soap from solid soap pieces at the bathtub faucet.

These together with other objects of the embodiment of the invention, along with the various feature of novelty that characterize the embodiment of the invention, are pointed out with particularity in the claims annexed to and forming a part of this disclosure. For a better understanding of the embodiment of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The embodiment of the invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
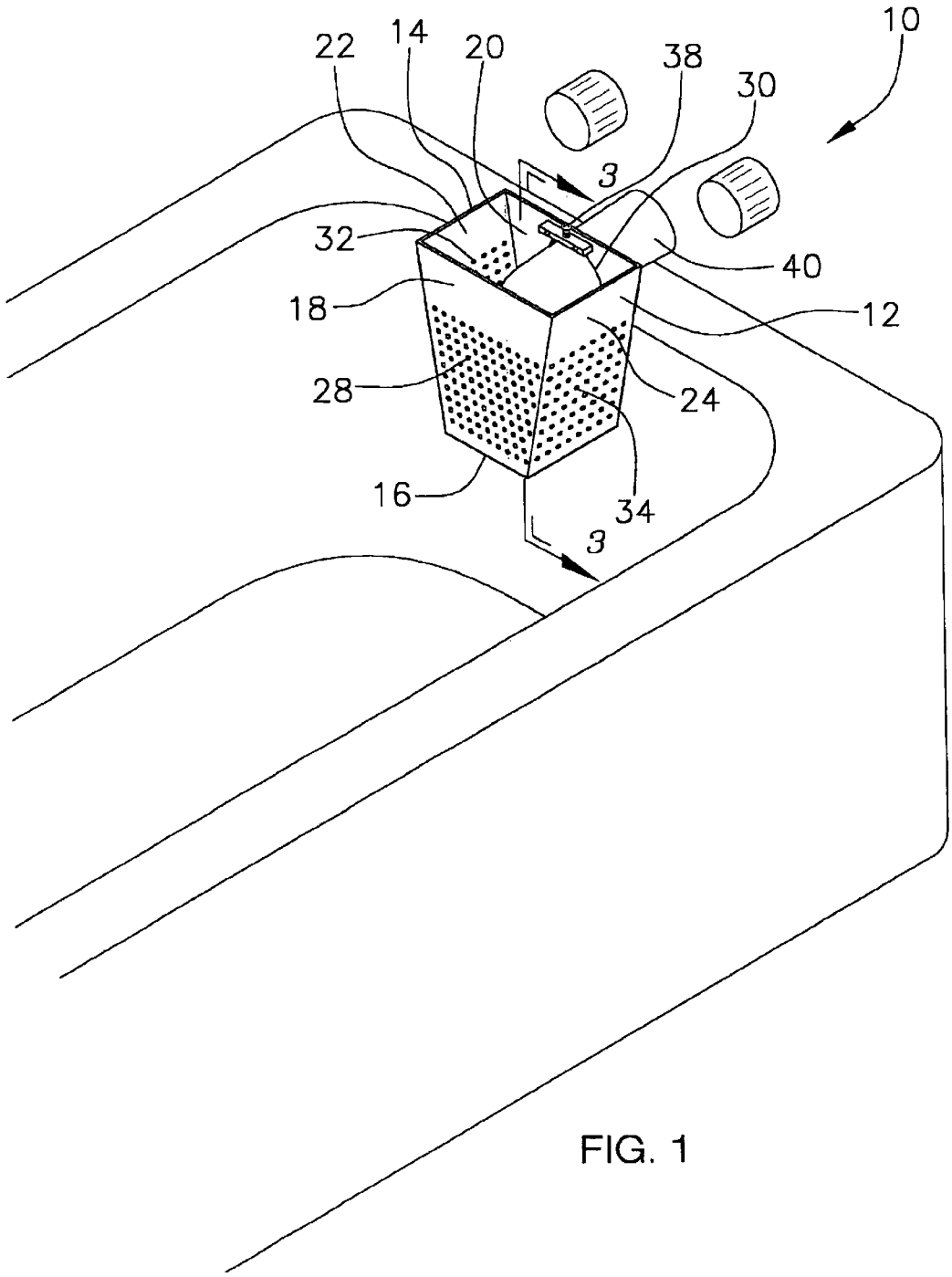
FIG. 1 is a top perspective view of the preferred embodiment of the dispenser for bathtub faucet constructed in accordance with the principles of the present invention.

Referring now to the drawings, and particularly to FIGS. 1–4, a preferred embodiment of the dispenser for bathtub faucet of the present invention is shown and generally designated by the reference numeral 10.

In FIG. 1, a new and improved dispenser for bathtub faucet 10 of the present invention for dispenser connectable to bathtub faucet is illustrated and will be described. More particularly, the dispenser for bathtub faucet 10 has a basket 12 having substantially the trapezoidal shape. The basket 12 has a top end 14, a bottom wall 16 (shown in FIG. 4), a front wall 18, a back wall 20, a left wall 22 and a right wall 24. The basket top end 14 is open. The basket 12 is capable of retaining solid soap pieces therein. The basket back wall 20 has a faucet bore 30 therethru. The faucet bore 30 is capable of allowing the passage of a bathtub faucet 40 therethru. The basket front wall 18 has a plurality of front wall perforations 28 therethru. The basket left wall 22 has a plurality of left wall perforations 32 therethru. The basket right wall 24 has a plurality of right wall perforations 34 therethru. The basket 12 width is 7½ inches. The basket 12 length is 8½ inches. The basket 12 depth is 5 inches. The basket 12 is comprised of plastic. A bracket 36 is connected to the basket back wall 20. The bracket 36 is connectable to the bathtub faucet 40. A securing screw 38 is threadably connected to the bracket 36 for frictionally engaging the bathtub faucet 40.

Figure 2:
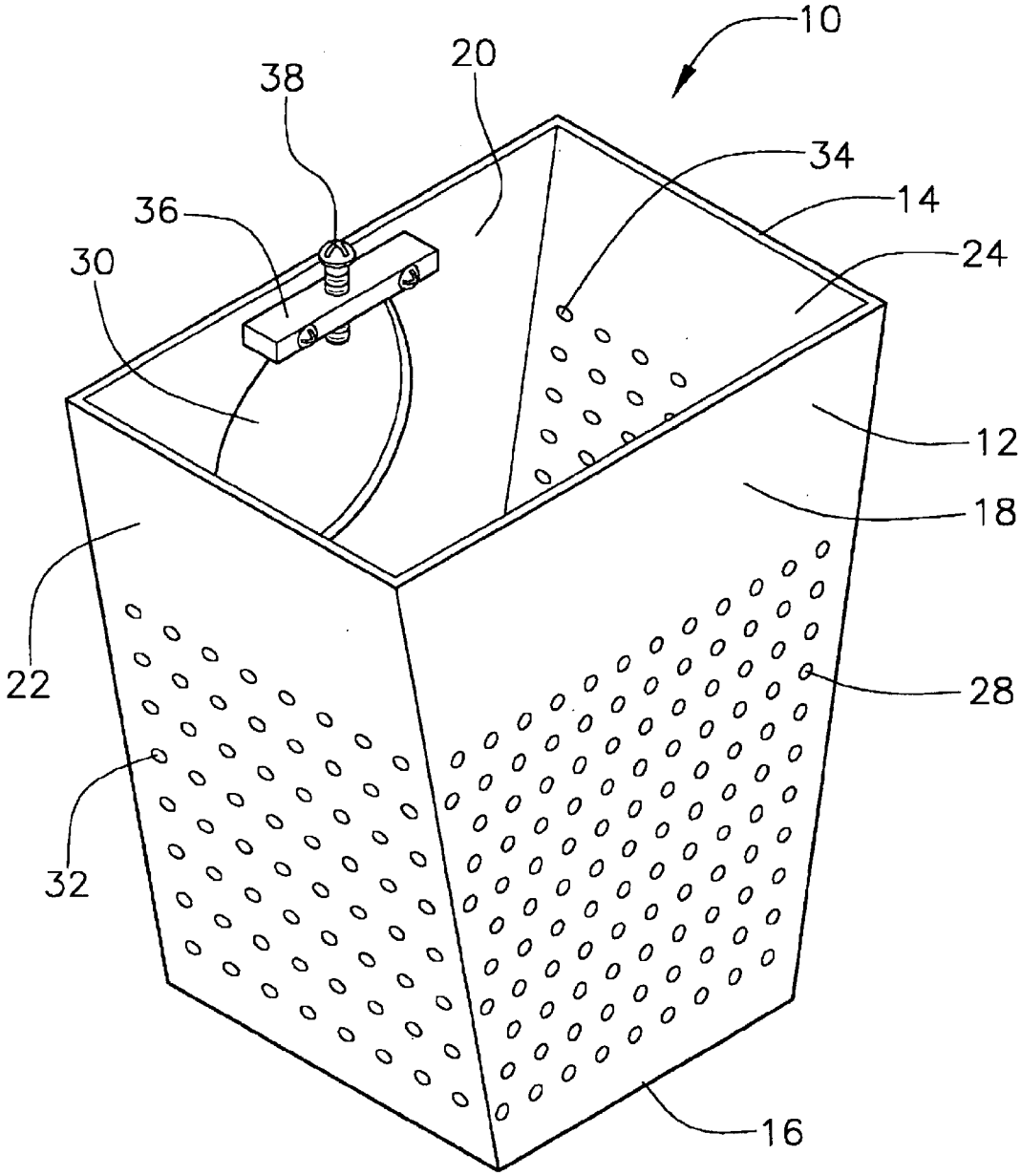
FIG. 2 is a top perspective view of the dispenser for bathtub faucet of the present embodiment of the invention.

In FIG. 2, the dispenser for bathtub faucet 10 is illustrated and will be described. More particularly, the dispenser for bathtub faucet 10 has the basket 12 having substantially the trapezoidal shape. The basket 12 has the top end 14, the bottom wall 16 (shown in FIG. 4), the front wall 18, tie back wall 20, the left wall 22 and the right wall 24. The basket top end 14 is open. The basket 12 is capable of retaining solid soap pieces therein. The basket back wall 20 has the faucet bore 30 therethru. The basket front wall 18 has the plurality of front wall perforations 28 therethru. The basket left wall 22 has the plurality of left wall perforations 32 therethru. The basket right wall 24 has the plurality of right wall perforations 34 therethru. The bracket 36 is connected to the basket back wall 20. The securing screw 38 is threadably connected to the bracket 36 for frictionally engaging the bathtub faucet 40.

Figure 3:
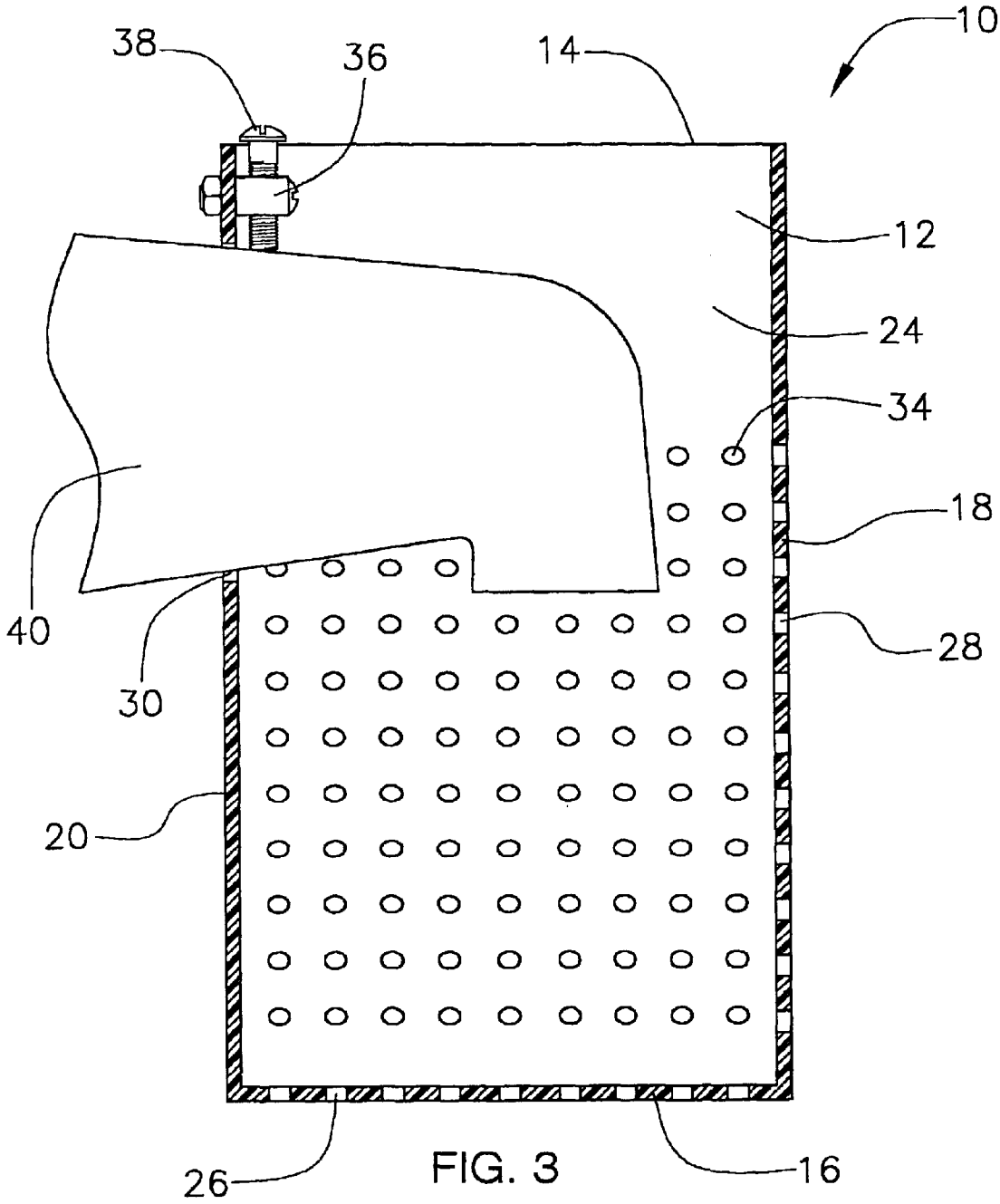
FIG. 3 is a section 3—3 view of FIG. 1 of the dispenser for bathtub faucet of the present embodiment of the invention.

In FIG. 3, the dispenser for bathtub faucet 10 is illustrated and will be described. More particularly, the dispenser for bathtub faucet 10 has the basket 12 having substantially the trapezoidal shape. The basket 12 has the top end 14, the bottom wall 16, the front wall 18, the back wall 20 and the right wall 24. The basket top end 14 is open. The basket bottom wall 16 has a plurality of bottom wall perforations 26 therein. The basket 12 is capable of retaining solid soap pieces therein. The basket back wall 20 has the faucet bore 30 therethru. The faucet bore 30 is capable of allowing the passage of the bathtub faucet 40 therethru. The basket front wall 18 has the plurality of front wall perforations 28 therethru. The basket right wall 24 has the plurality of right wall perforations 34 therethru. The bracket 36 is connected to the basket back wall 20. The bracket 36 is connectable to the bathtub faucet 40. The securing screw 38 is threadably connected to the, bracket 36 for frictionally engaging the bathtub faucet 40.

Figure 4:
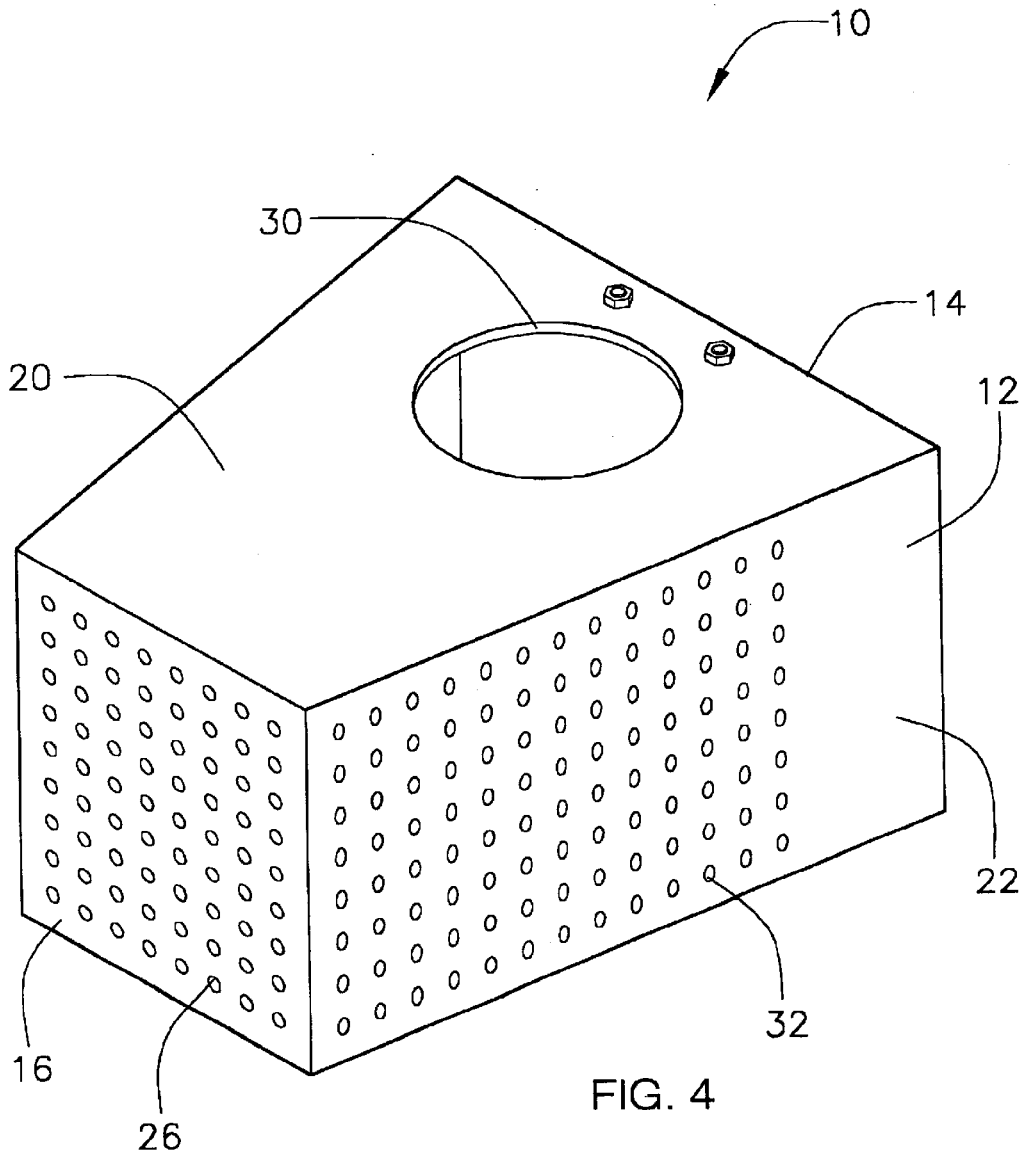
FIG. 4 is a back perspective view of the dispenser for bathtub faucet of the present embodiment of the invention.

In FIG. 4, the dispenser for bathtub faucet 10 is illustrated and will be described. More particularly, the dispenser for bathtub faucet 10 has the basket 12 having substantially the trapezoidal shape. The basket 12 has the bottom wall 16, the back wall 20 and the left wall 22. The basket bottom wall 16 has the plurality of bottom wall perforations 26 therein. The basket 12 is capable of retaining solid soap pieces therein. The basket back wall 20 has the faucet bore 30 therethru. The basket left wall 22 has the plurality of left wall perforations 32 therethru.

In use it can now be understood that to use the dispenser for bathtub faucet 10 solid soap pieces are placed in the basket and dissolve when the bathtub faucet 40 is turned on.

While a preferred embodiment of the dispenser for bathtub faucet has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present embodiment of the invention. For example, any suitable sturdy material such as aluminum or steel may be used instead of the plastic basket described. And although dispenser connectable to bathtub faucet have been described, it should be appreciated that the dispenser for bathtub faucet herein described is also suitable for dispensing vitamins to animals.

Therefore, the foregoing is considered as illustrative only of the principles of the embodiment of the invention. Further, since numerous modifications and changes will readily occur to those skilled in the art, it is not desired to limit the embodiment of the invention to the exact construction and operation shown and described, and accordingly, all suitable modifications and equivalents may be resorted to, falling within the scope of the embodiment of the invention.

We claim:

1. A dispenser for bathtub faucet comprising:

a basket having a substantially trapezoidal shape, said basket having a top end, a bottom wall, a front wall, a back wall, a left wall and a right wall, said basket top end being open, said basket bottom wall having a plurality of bottom wall perforations therein, said basket capable of retaining solid soap pieces therein, said basket back wall having a faucet bore therethru, said faucet bore capable of allowing the passage of a bathtub faucet therethru; and a bracket connected to said basket back wall, said bracket connectable to a bathtub faucet.

2. The dispenser for bathtub faucet of claim 1 wherein:

said basket front wall having a plurality of front wall perforations therethru.

3. The dispenser for bathtub faucet of claim 2 wherein:

said basket left wall having a plurality of left wall perforations therethru.

4. The dispenser for bathtub faucet of claim 3 wherein:

said basket right wall having a plurality of right wall perforations therethru.

5. The dispenser for bathtub faucet of claim 4 further comprising:

a securing screw threadably connected to said bracket for frictionally engaging said bathtub faucet.

6. The dispenser for bathtub faucet of claim 5 wherein:

said basket width is 7½ inches.

7. The dispenser for bathtub faucet of claim 6 wherein:

said basket length is 8½ inches.

8. The dispenser for bathtub faucet of claim 7 wherein:

said basket depth is 5 inches.

9. The dispenser for bathtub faucet of claim 8 wherein:

said basket is comprised of plastic.

10. A dispenser for bathtub faucet comprising:

a basket having a substantially trapezoidal shape, said basket having a top end, a bottom wall, a front wall, a back wall, a left wall and a right wall, said basket top end being open, said basket bottom wall having a plurality of bottom wall perforations therein, said basket capable of retaining solid soap pieces therein, said basket back wall having a faucet bore therethru, said faucet bore capable of allowing the passage of a bathtub faucet therethru, said basket front wall having a plurality of front wall perforations therethru, said basket left wall having a plurality of left wall perforations therethru, said basket right wall having a plurality of right wall perforations therein, said basket width is 7½ inches, said basket length is 8½ inches, said basket depth is 5 inches, said basket is comprised of plastic;

a bracket connected to said basket back wall, said bracket connectable to a bathtub faucet; and a securing screw threadably connected to said bracket for frictionally engaging said bathtub faucet.

* * * * *